United States Patent [19]

Weidmann

[11] 4,178,590

[45] Dec. 11, 1979

[54] ELECTRONIC WEFT THREAD MONITOR FOR SHUTTLELESS WEAVING MACHINES

[75] Inventor: Erich Weidmann, Wetzikon, Switzerland

[73] Assignee: Gebrüder Loepfe AG, Zurich, Switzerland

[21] Appl. No.: 870,181

[22] Filed: Jan. 17, 1978

[30] Foreign Application Priority Data

Feb. 12, 1977 [CH] Switzerland ..... 001966/77

[51] Int. Cl.[2] ..... B65H 63/00; D04B 35/14; G08B 21/00

[52] U.S. Cl. ..... 340/677; 28/187; 73/5; 73/160; 139/370.2; 139/353; 340/501

[58] Field of Search ..... 340/506, 501, 514, 677, 340/673, 674, 675, 309.1; 139/370.1, 370.2, 371, 353; 73/1 R, 5, 160; 28/186, 187

[56] References Cited

U.S. PATENT DOCUMENTS

| | | | |
|---|---|---|---|
| 3,440,634 | 4/1969 | Maurmann et al. | 340/677 |
| 3,489,910 | 1/1970 | Bohme et al. | 28/187 X |
| 3,688,958 | 9/1972 | Rydborn | 28/187 X |
| 3,863,241 | 1/1975 | Kamiyamaguch | 340/677 X |
| 3,911,969 | 10/1975 | Rydborn | 340/677 X |
| 3,989,068 | 11/1976 | Kakinaka | 139/370.1 X |
| 4,041,985 | 8/1977 | Gotoh | 139/370.2 |

*Primary Examiner*—John W. Caldwell, Sr.
*Assistant Examiner*—Joseph E. Nowicki
*Attorney, Agent, or Firm*—Werner W. Kleeman

[57] ABSTRACT

The invention is concerned with an electronic device enabling an operator to easily and correctly adjust the time interval in which the weft insertion in shuttleless looms fitted with an electronic weft or filling thread monitor is to be monitored. A safety interval of some milliseconds' duration is provided at the end of said time interval taking into account the unavoidable fluctuations of the weft insertion period.

6 Claims, 4 Drawing Figures

ELECTRONIC WEFT THREAD MONITOR FOR SHUTTLELESS WEAVING MACHINES

BACKGROUND OF THE INVENTION

The present invention relates to a new electronic weft or filling thread monitoring device for shuttleless looms or weaving machines, such as gripper shuttle and rapier weaving machines. Generally, such a monitoring device serves for stopping the loom as soon as the weft thread breaks or is prematurely released from the gripper member during insertion into the weaving shed.

A gripper shuttle weaving machine provided with an optical weft thread monitoring apparatus is shown and described in U.S. Pat. No. 3,489,910, by way of example. Swiss Pat. No. 489,642 discloses a device for monitoring the weft thread on gripper shuttle weaving machines, said device comprising a preferably weft contacting sensor arranged on the picking side of the machine between supply spool and weaving shed, and circuitry determining a monitoring interval in which part of the weft insertion period is supervised. Such circuitry comprises a control member located near the end of the gripper shuttle race and producing a control pulse determining the end of the monitoring interval when the gripper shuttle passes the control member. The latter may be mounted near or within a gripper shuttle catch box. Preferably this control device is arranged ahead of the catch box since its mounting within the same is not possible without engineering changes and thus is not generally practicable. However, with such preferred arrangement, the control pulse appears so early that the monitoring interval is terminated prior to the stoppage of the gripper shuttle and weft or filling thread. As a consequence, the thread is no longer monitored during the last phase of its travel, i.e. after the gripper shuttle has passed the control device. This last phase may comprise a time interval of ten milliseconds or more. Now in order to reduce this non-monitored time interval, the control or controlling pulse, as disclosed in the aforementioned Swiss patent, may be delayed by a constant amount such that the monitoring interval is prolonged by the same amount.

However, the duration of such last phase of the filling insertion period depends upon the type of weaving machine, the adjustment and the working conditions thereof, and in particular the type of filling yarn. Thus it is desirable that the amount of such time delay should be fixed according to circumstances. By way of example, the optimal delay may be in the range from six to twelve milliseconds. The delay may be set by shifting and adjusting the control device generating a controlling pulse along the path of the gripper shuttle. However, such measure requires additional expenditure of mechanical means and, moreover, generally is impracticable due to lack of space. Furthermore, special measuring equipment is required for checking the correct setting, so that only trained personnel is able to perform the setting.

SUMMARY OF THE INVENTION

Thus, it is a main objective of the invention to provide, for an electronic weft or filling monitor mounted on a shuttleless weaving machine, indicating means enabling an operator to easily and optimally adjust the final point of the monitoring interval.

It is a further object of the invention to provide, for an electronic filling monitor comprising a signal channel producing a thread travel signal and trigger circuitry generating a controlling signal or pulse defining the duration of the monitoring interval, a variable delay circuit for adjusting the termination of the control signal.

BRIEF DESCRIPTION OF THE DRAWINGS

The invention will be better understood and objects other than those set forth above will become apparent upon consideration of the following detailed description thereof which refers to the annexed drawings wherein.

DETAILED DESCRIPTION OF THE INVENTION

Figure 1:
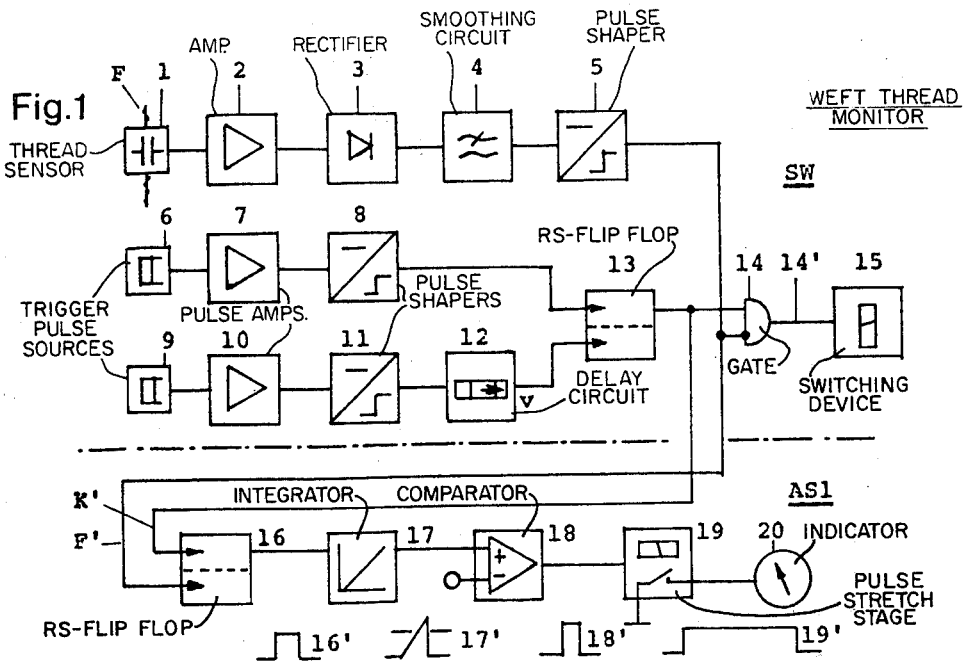
FIG. 1 shows a first embodiment of the new weft thread monitoring device and cooperating indicator circuitry, in block diagram.

With reference to FIG. 1 the components comprised by the weft thread monitor SW, —without indicator circuitry—, as far as they are essential for understanding the invention, are characterized by numerals 1–15, whereas the indicator circuitry AS1 comprises the components 16–20.

The weft thread monitor SW is mounted on a weaving machine (not shown) and may be designed in an essentially known manner. A thread sensor 1 acted upon by weft or filling thread F is preferably located on the picking side of the machine between supply spool and selvedge. Thread sensor 1 may comprise a conventional piezoelectrical, capacitive, triboelectrical or optoelectrical transducer and produces a sensing signal shaped as an irregular alternating or noise potential when the thread is traveling. A series circuitry comprising amplifier 2, rectifier 3, smoothing circuit 4 and pulse shaper 5 is connected to thread sensor 1. The components 1–5 form a signal processing channel or signal channel furnishing a thread travel signal or pulse F'. The output terminal of signal channel 1–5 is connected to a negating or inverting input of an AND-gate 14. This negating input receives the thread travel signal F' shaped as a rectangular pulse which is prematurely terminated when weft thread F breaks or comes to a standstill.

Blocks 6–13 represent trigger circuitry serving for producing a controlling pulse K'. Firstly, trigger circuitry 6–13 comprises first and second trigger pulse sources 6 and 9, respectively. Normally, the first trigger pulse source 6 is periodically tripped by an element synchronously rotated by the drive shaft of the weaving machine and may be designed as an induction coil cooperating with a rotating permanent magnet, or may be a proximity switch actuated by a rotating magnetic lug. Thus, in each working cycle of the weaving machine a first trigger pulse is generated which defines the start of the monitoring interval. The second trigger pulse source 9 is normally mounted near the path of the rapier or gripper shuttle on the weft receiving or catch side of the machine and furnishes a second trigger pulse at the end of the weft insertion. The second trigger pulse essentially defines the end of controlling pulse K' and thus the end of the monitoring interval.

A series connection of a pulse amplifier 7 and a pulse shaper 8 and a pulse amplifier 10 and a pulse shaper 11 is operatively connected to each of the trigger pulse sources 6 and 9, respectively. Pulse shaper 11 is followed by a delay circuit 12 which is adjustable with respect to the duration of its delay v and acts upon the trailing edge of the second trigger pulse produced by pulse shaper 11. The outputs of pulse shaper 8 and delay circuit 12 are connected to the not particularly referenced set input and reset input, respectively, of a RS-flipflop 13 forming the end or output stage of the trigger circuitry 6–13 and furnishing a controlling pulse K' which is supplied to the not negating input of AND-gate 14. In order to obtain correct operation of the weaving machine free of improper stoppages, the end of controlling pulse K' should be adjusted by means of delay circuit 12 such that it occurs, with orderly weft insertion, some, e.g. three milliseconds prior to the end of thread travel pulse F'. Such a safety interval ts between the end of controlling pulse K' and thread travel pulse F' is advantageous in view of the unavoidable deviations of the duration of the thread travel pulse F' during normal operation of the weaving machine.

Delay circuit 12 may be designed as a monostable circuit or monoflop. Delay v may be varied continually by adjusting the time constant of the monoflop defining the duration of the output pulse of delay circuit 12, by means of a variable resistor or potentiometer. Alternatively the time constant may be varied in steps when desirable.

In case the setting of delay circuit 12 and the operation of the weaving machine are correct, AND-gate 14 having an inverting input produces no switching pulse which might actuate switching device 15, since AND-gate 14 remains blocked for controlling pulse K' due to a thread travel pulse F' supplied to the inverting input of AND-gate 14. However, such a switching pulse 14' is generated when thread travel pulse F' terminates prior to control pulse K' as a consequence of a thread break, thus stopping the weaving machine.

Circuitry AS1 provided for indicating the setting of weft thread monitor SW comprises a series connection of RS-flip-flop 16, integrator 17, comparator or threshold stage 18, pulse stretching stage 19 and indication device 20. The circuits 16–18 designed for producing a timing pulse 18' provide a timing circuitry.

The set input of RS-flipflop 16 is connected to the output of RS-flipflop 13 of trigger circuitry 6–13, whereas the reset input is connected to the output of pulse former 5 of signal channel 1–5. In case delay circuit 12 is set such that controlling pulse K' ends prior to thread travel pulse F', RS-flipflop 16 of indicator circuitry AS1 furnishes a short difference pulse 16' of duration t for each weft insertion. Now indicator circuitry AS1 is designed in such a manner that only difference pulses 16' are indicated whose duration t surmounts the duration ts of the safety interval of e.g. three milliseconds. For this purpose difference pulse 16' is transformed into a triangle pulse 17' by integrator 17. The threshold of comparator 18 following integrator 17 is set such that the latter generates a timing pulse 18' whose duration is shorter than the duration t of difference pulse 16' by the amount ts of the safety interval. Thus, when the difference pulse 16' is longer than the safety interval ts, the duration t−ts of timing pulse 18' equals the time interval between the end of thread travel pulse F' and the end of the preceding controlling pulse K', diminished by the safety interval ts. However, when difference pulse 16' is equal to or shorter than the safety interval ts, no timing pulse 18' is produced. In the first event indication device 20 is actuated, however, no indication occurs in the second event. Pulse stretching stage 19 has the sole purpose to stretch timing pulse 18' such that safe indication and reading is ensured. Pulse stretching stage 19 may produce an indicator pulse of 500 milliseconds, by way of example.

Setting may be performed by means of delay circuit 12 with the weaving machine operating. To begin with, a short delay v is chosen such that the control pulse K' terminates immediately prior to thread travel pulse F', and an indication appears on each weft insertion. Thereafter, the delay v is increased to such an extent that indicator device 20 is actuated only occasionally within a series of weft insertions. With such a setting, the mean time difference between the end of controlling pulse K' and the end of thread travel pulse F' is about three milliseconds, i.e. the duration of the safety interval ts fixed by comparator 18.

Continuous or repeated response of indication device 20 in indicator circuitry AS1 indicates that delay v is set too short on delay circuit 12, or that the duration of difference pulse 16' t is too long.

Figure 2:
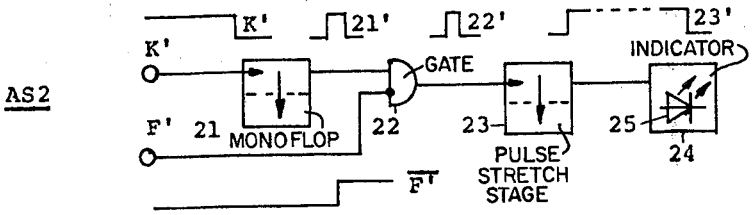
FIG. 2 is a block schematic of a second embodiment of the indicator circuitry.

The indicator circuitry AS2 shown in FIG. 2 may be used in place of indicator circuitry AS1 shown in FIG. 1. Circuitry AS2 comprises timing circuitry 21,22, pulse stretching stage 23 and indication device 24 equipped with a light emitting diode 25 or other indication means.

The timing circuitry 21,22 comprises a first monostable circuit or monoflop 21 and an AND-gate 22 having an inverting or negating input. Pulse stretching stage 23 may be designed as a monostable circuit or monoflop furnishing, upon actuation, an indicator pulse 23' whose duration may be in the range from about 200 to 1000 milliseconds.

The setting process beings as mentioned above, by adjusting delay circuit 12 to a short delay v, whereupon the weaving machine is started. With such adjustment, controlling pulse K' may terminate, by way of example at a time interval t=5 milliseconds prior to thread travel pulse F'.

The first monostable circuit 21 is tripped by the rear or trailing edge of controlling pulse K' and generates a safety pulse 21' of a duration of e.g. three milliseconds. The safety pulse 21' is compared with the negated or inverted thread travel pulse $\overline{F'}$ in AND-gate 22. Assuming the interval t between the end of pulse K' and the end of pulse F'—or the end of inverted pulse $\overline{F'}$—is five milliseconds, then this means that the pulse F' and $\overline{F'}$ terminate two milliseconds after safety pulse 21'. In this event or generally when t>ts, no timing pulse 22' and no indication will occur.

Now when the delay v at delay circuit 12 is gradually increased and a certain setting is attained, light emitting diode 25 will continually or repeatedly respond during successive weft insertions. Thereupon, delay v is adjusted in such a manner that within a rather long series of weft insertions light diode 25 only occasionally responds. Thereupon, the setting process is finished. In this event, the time interval t between the end of controlling pulse K' and the end of thread travel pulse F' is substantially equal to the duration ts of the safety pulse 21'.

With reference to FIG. 2, the following may explain that procedure. By increasing the delay v, the safety pulse 21' is moved as far to the right side that it overlaps the rear edge of thread travel pulse F' or rising edge of inverted pulse $\overline{F'}$. Thus, a timing pulse 22' is generated whose duration equals ts−t as long as the thread travel pulse F' ends within safety pulse 21'. Timing pulse 22' is stretched to e.g. 500 milliseconds in pulse stretching stage 23, and the stretched indicator pulse 23' causes light emitting diode 25 to flash up for the same time interval. By carefully reducing delay v by means of delay circuit 12 the trailing edge of safety pulse 21' is made to coincide with the edge of thread travel pulse F' or $\overline{F'}$, and the setting process is finished.

During this procedure, the weft thread monitor SW, FIG. 1, does not produce a switching pulse 14' since controlling pulse K' terminates prior to thread travel pulse F'—provided no weft break occurs accidentally during the setting procedure.

Continuous or repeated response of indication device 24 in indicator circuitry AS2 signals that delay v of delay circuit 12 is set too long, or the duration t is too short, that means t<ts.

Figure 3:
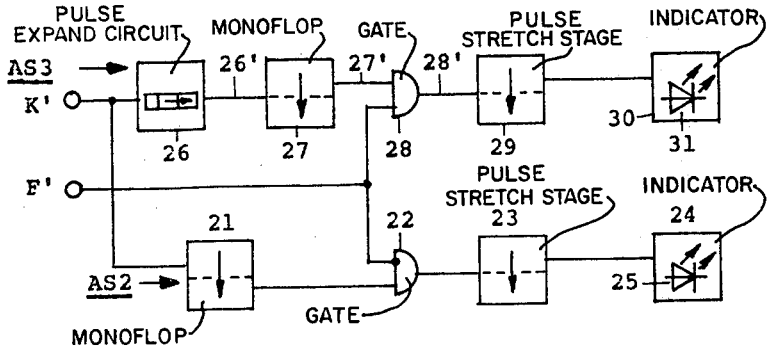
FIG. 3 is a block diagram of a further double indicator circuitry.

The double indicator circuitry shown in FIG. 3 consists of two parallel circuits, one of which AS3 comprises the components 26–30 and the second AS2 the components 21–24. This second circuit or circuitry AS2 is identical with the one shown in FIG. 2 and thus need not be here further explained in detail. The function of indicator circuitry AS3 corresponds to that of indicator circuitry AS1, however, these circuits are different in design.

Indicator circuitry AS3 as shown in the upper half of FIG. 3 comprises a pulse expanding circuit 26, a monostable circuit or monoflop 27, an AND-gate 28, a pulse stretching stage 29 and an indication device 30 equipped with a light emitting diode 31. Pulse expanding circuit 26, monostable circuit 27 and AND-gate 28 form a timing circuit 26–28. The components 29 and 30 may be designed like the components 23 and 24, respectively, of indicator circuitry AS2, FIG. 2 and FIG. 3. Pulse expanding circuit 26 is supplied with controlling pulse K' which is expanded by a second safety interval t's whose duration, e.g. five milliseconds, should be somewhat greater than the duration ts of the first safety interval pertinent to circuitry AS2. The expanded control pulse 26' is supplied to monostable circuit 27, in which the trailing edge of pulse 26' trips a supplemental pulse 27' of e.g. 10 milliseconds duration. The supplemental pulse 27' is supplied to one input of AND-gate 28, the other input of which receives the thread travel pulse F'. AND-gate 28 produces a timing pulse 28' of duration t−t's only when supplemental pulse 27' begins prior to the trail of thread travel pulse F', i.e. if t>t's. In this event, light emitting diode 31 flashes up to provide an indication.

Figure 4:
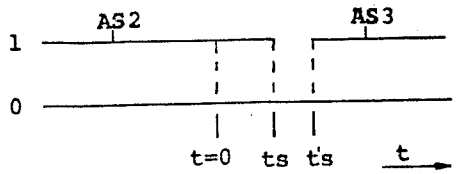
FIG. 4 is a pulse diagram illustrating the mode of operation of the double indicator circuitry shown in FIG. 3.

The mode of indication of the double indicator circuitries AS2,AS3 shown in FIG. 3 is illustrated by FIG. 4, where the magnitude of the time interval t between the end of controlling pulse K' and the end of thread travel pulse F' is plotted along the abscissa. Response of the indicator circuitries AS2,AS3 is represented by ordinate values 1.

It is obvious from FIG. 4 that indicator circuitry AS2 responds when t<ts, whereas AS3 responds when t>t's. Within the range ts<t<t's neither indicator circuitry responds, indicating the correct setting of weft thread monitor SW.

It should be noted that only positive values of t are importent to the setting procedure when the weaving machine is working, since with negative values a switching pulse 14' is produced and stops the machine.

As an alternative, t's may be chosen smaller than ts; in this event, the correct setting of the weft thread monitor SW is indicated by both light emitting diodes 25,31 flashing up.

While there are shown and described present preferred embodiments of the invention, it is to be distinctly understood that the invention is not limited thereto but may be otherwise variously embodied and practiced within the scope of the following claims. ACCORDINGLY,

What is claimed is:

1. In an electronic weft thread monitoring device for shuttleless weaving machines, comprising a signal processing channel producing at its output an output signal in the form of a thread travel signal indicative of weft insertion; trigger circuitry controlled by the weaving machine and producing at its output an output signal in the form of a signal controlling the duration of monitoring the thread travel signal, the trigger circuitry comprising a delaying circuit for delaying the end of the controlling signal, the improvement which comprises:

the delaying circuit being provided with delay setting means;

timing circuitry having first and second input means respectively connected with the outputs of said signal processing channel and said trigger circuitry, said timing circuitry being actuated by the output signals of said signal processing channel and trigger circuitry, for generating a timing pulse indicating the time difference between the end of the thread travel signal and the controlling signal, minus a predetermined safety interval;

said timing circuitry having an output; and indicator means connected in circuit with said output of said timing circuitry for indicating said time difference on the output of said timing circuitry.

2. The monitoring device as defined in claim 1, wherein said timing circuitry comprises a series connection of a RS-flipflop having a set input defining said second input means and a reset input defining said first input means, integrator and comparator structured as a threshold value stage, the set input of RS-flipflop being connected to the output of the trigger circuitry, and the reset input of the RS-flipflop being connected to the output of the signal processing channel.

3. The monitoring device as defined in claim 1, wherein said timing circuitry comprises a first timing circuit containing a monostable circuit having an input defining said second input means and having an output and an AND-gate having a first input and a second negating input defining said first input means, the monostable circuit producing a safety pulse signal of some milliseconds' duration when tripped by a rear edge of the controlling signal, the first input of said AND-gate being connected to the output of said monostable circuit, and the second negating input of said AND-date being connected to the output of the signal processing channel.

4. The monitoring device as defined in claim 3, wherein said timing circuitry further comprises a second timing circuit containing a series connection of a pulse expander having an input, further defining said second input means, a monostable circuit having an output, and an AND-gate having first and second inputs, said second input further defining said first input means, the input of the pulse expander being connected to the output of the trigger circuitry, and the first and second inputs of the AND-gate of the second timing circuit being connected to the respective output of the monostable circuit of the second timing circuit and said signal processing channel.

5. A monitoring device as claimed in claim 4, wherein said first and second timing circuits are connected in parallel, and said indicator means comprises respective individual indication devices operatively associated with each timing circuit.

6. The monitoring device as defind in claim 1, wherein said timing circuitry comprises a series connection of a pulse expander having an input defining said second input means, a monostable circuit having an output, and an AND-gate having first and second inputs, said second input defining said first input means, the input of the pulse expander being connected to the output of the trigger circuitry, and the first and second inputs of the AND-gate being connected to the respective outputs of the monostable circuit and signal processing channel.

* * * * *